US007658212B2

(12) United States Patent
Meuleners et al.

(10) Patent No.: US 7,658,212 B2
(45) Date of Patent: Feb. 9, 2010

(54) LIQUID DISPENSER ASSEMBLY FOR USE WITH AN APPLIANCE

(75) Inventors: William J. Meuleners, Faribault, MN (US); Karl Fritze, Denmark Township, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/197,752

(22) Filed: Aug. 25, 2008

(65) Prior Publication Data

US 2009/0025826 A1 Jan. 29, 2009

Related U.S. Application Data

(63) Continuation of application No. 11/039,363, filed on Jan. 20, 2005, now abandoned.

(60) Provisional application No. 60/537,781, filed on Jan. 20, 2004.

(51) Int. Cl.
*B65B 3/04* (2006.01)
*B67D 3/00* (2006.01)

(52) U.S. Cl. ..... 141/82; 141/360; 141/375; 222/146.6; 62/339; 62/391

(58) Field of Classification Search ..... 141/82, 141/351, 360, 369, 375; 137/544–546; 222/146.6; 62/337–339, 389, 391
See application file for complete search history.

(56) References Cited

U.S. PATENT DOCUMENTS

| | | | | |
|---|---|---|---|---|
| 1,848,848 | A | 3/1932 | Sloan | |
| 1,863,249 | A | 6/1932 | Morairty et al. | |
| 2,781,153 | A * | 2/1957 | Roberts | 222/183 |
| 3,561,506 | A | 2/1971 | Johnson | |
| 3,727,764 | A | 4/1973 | Ogden | |
| 3,746,171 | A | 7/1973 | Thomsen | |
| 3,852,196 | A | 12/1974 | Szpur | |
| 3,859,216 | A | 1/1975 | Sisson et al. | |
| 3,914,176 | A | 10/1975 | Holmes | |
| 3,982,406 | A | 9/1976 | Hanson et al. | |
| 4,006,752 | A | 2/1977 | De Vale | |
| 4,051,036 | A | 9/1977 | Conrad et al. | |
| 4,082,673 | A | 4/1978 | Cilento | |

(Continued)

FOREIGN PATENT DOCUMENTS

| | | |
|---|---|---|
| DE | 4428471 | 2/1996 |

(Continued)

*Primary Examiner*—Timothy L Maust
*Assistant Examiner*—Nicolas A Arnett
(74) *Attorney, Agent, or Firm*—Aleksander Medved

(57) ABSTRACT

A liquid filtering and dispensing system can be formed as an integral unit and configured for placement within an appliance compartment. The system can have a manifold with a filter connection including inflow and outflow attachments for a filter cartridge, an inlet, at least one outlet forming a dispenser and a valve to control flow through the integral system. The system can include a cooling reservoir fluidly located prior to the dispenser. The system can include a removable carafe and a carafe mount configured such that the carafe can receive liquid from the dispenser. The carafe mount can be configured to supply liquid from the carafe to a remote dispensing assembly such as a refrigerator door dispenser. The carafe mount can be positioned within the refrigerator compartment or within the refrigerator door.

8 Claims, 10 Drawing Sheets

U.S. PATENT DOCUMENTS 4,440,200 A 4/1984 De Vale et al.
4,515,692 A 5/1985 Chandler et al.
4,529,514 A 7/1985 Gruett
4,556,484 A 12/1985 Hunter et al.
4,645,601 A 2/1987 Regunathan et al.
4,654,142 A 3/1987 Thomsen et al.
D290,386 S 6/1987 Padilla
D291,479 S 8/1987 Padilla et al.
4,725,323 A 2/1988 Ostreicher et al.
4,725,354 A 2/1988 Thomsen et al.
4,731,184 A 3/1988 Ostreicher et al.
4,735,716 A 4/1988 Petrucci et al.
4,739,629 A 4/1988 True
D296,463 S 6/1988 Padilla
4,753,728 A 6/1988 VanderBilt et al.
4,759,474 A 7/1988 Regunathan et al.
4,769,052 A 9/1988 Kowalski
4,770,770 A 9/1988 Regunathan et al.
4,806,240 A 2/1989 Giordano et al.
4,857,189 A 8/1989 Thomsen et al.
4,865,738 A 9/1989 Black et al.
4,877,521 A 10/1989 Petrucci et al.
4,882,061 A 11/1989 Petrucci et al.
4,904,382 A 2/1990 Thomsen
D306,754 S 3/1990 Petrucci et al.
D306,755 S 3/1990 Petrucci et al.
4,915,831 A 4/1990 Taylor
4,923,601 A 5/1990 Dori
4,948,505 A 8/1990 Petrucci et al.
4,956,086 A 9/1990 Thomsen et al.
D313,832 S 1/1991 Petrucci et al.
D314,809 S 2/1991 Petrucci et al.
D315,013 S 2/1991 Petrucci et al.
5,013,434 A 5/1991 Furrow
5,015,316 A 5/1991 Ostreicher et al.
5,022,986 A 6/1991 Lang
5,028,327 A 7/1991 Ostreicher et al.
D320,256 S 9/1991 Giordano et al.
D321,394 S 11/1991 Petrucci et al.
D322,836 S 12/1991 Petrucci et al.
5,069,786 A 12/1991 Pulek
5,083,442 A * 1/1992 Vlock ..... 62/338
5,116,502 A 5/1992 Ferguson
5,126,043 A 6/1992 Giordano et al.
5,126,044 A 6/1992 Magnusson et al.
RE34,031 E 8/1992 Thomsen et al.
5,135,645 A 8/1992 Sklenak et al.
RE34,050 E 9/1992 Thomsen et al.
5,151,180 A 9/1992 Giordano et al.
5,164,085 A 11/1992 Spokoiny et al.
5,167,814 A 12/1992 Pulek
5,269,919 A 12/1993 von Medlin
5,277,805 A 1/1994 Ferguson
5,304,300 A 4/1994 Parsons
5,328,609 A 7/1994 Magnusson et al.
5,336,406 A 8/1994 Stanford et al.
5,354,464 A 10/1994 Slovak et al.
5,399,264 A 3/1995 Pulek et al.
5,482,624 A 1/1996 Swiatek et al.
5,486,288 A 1/1996 Stanford et al.
5,490,547 A 2/1996 Abadi et al.
5,526,854 A 6/1996 Unger
5,527,470 A 6/1996 Suda
5,542,265 A * 8/1996 Rutland ..... 62/389
5,562,824 A 10/1996 Magnusson
5,591,332 A 1/1997 Reid et al.
5,653,871 A 8/1997 Thomsen
5,653,878 A 8/1997 Reid
5,683,015 A 11/1997 Lee
5,705,067 A 1/1998 Sumi et al.
5,707,518 A 1/1998 Coates et al.
5,753,107 A 5/1998 Magnusson et al.
5,779,903 A 7/1998 Smith et al.
5,791,523 A 8/1998 Oh
5,813,246 A 9/1998 Oh
5,819,547 A 10/1998 Oh
5,826,854 A 10/1998 Janvrin et al.
5,833,849 A 11/1998 Primdahl
5,891,333 A 4/1999 Ferguson
5,914,037 A 6/1999 Yen
5,919,360 A 7/1999 Contaxis et al.
5,919,362 A 7/1999 Barnes et al.
D413,961 S 9/1999 Bassett
5,956,967 A * 9/1999 Kim ..... 62/390
5,965,019 A 10/1999 Olsen et al.
6,003,734 A * 12/1999 Oh ..... 222/146.6
6,027,644 A 2/2000 Magnusson et al.
6,139,741 A 10/2000 McGibbon
6,193,884 B1 2/2001 Magnusson et al.
6,216,754 B1 4/2001 Geroult et al.
6,303,031 B1 10/2001 Senner
6,325,929 B1 12/2001 Bassett
6,337,015 B1 1/2002 Poirier
6,355,177 B2 3/2002 Senner et al.
6,451,202 B1 9/2002 Kuennen et al.
6,460,367 B1 10/2002 DuHack
6,485,641 B1 11/2002 McLeod
6,491,868 B2 12/2002 Kuennen et al.
6,514,420 B2 2/2003 Kuennen et al.
6,574,984 B1 6/2003 McCrea et al.
6,632,355 B2 10/2003 Fritze
6,649,056 B2 11/2003 Fritze
6,708,741 B1 3/2004 Berry et al.
6,810,683 B2 11/2004 Eustice
6,843,912 B2 1/2005 Chaney et al.
7,278,552 B2 * 10/2007 Crisp, III ..... 222/129.1
7,389,895 B2 * 6/2008 Crisp, III ..... 222/484
7,419,073 B2 * 9/2008 Crisp et al. ..... 222/129.1
2002/0017497 A1 2/2002 Fritze
2003/0010698 A1 1/2003 Fritze
2003/0019805 A1 1/2003 Fritze
2003/0019819 A1 1/2003 Fritze
2003/0024860 A1 2/2003 Fritze
2003/0102671 A1 6/2003 Fritze
2003/0217959 A1 11/2003 Fritze
2003/0227169 A1 12/2003 Fritze et al.
2004/0007516 A1 1/2004 Fritze et al.
2004/0021318 A1 2/2004 Fritze et al.
2004/0094468 A1 5/2004 Fritze
2004/0201212 A1 10/2004 Marks
2004/0231353 A1 11/2004 Schuchart et al.
2004/0251192 A1 12/2004 Fritze et al.
2004/0251210 A1 12/2004 Fritze et al.

FOREIGN PATENT DOCUMENTS

DE 4430925 3/1996
EP 1190983 A2 3/2002
WO WO 03/102481 A1 12/2003

* cited by examiner

FIG. 9
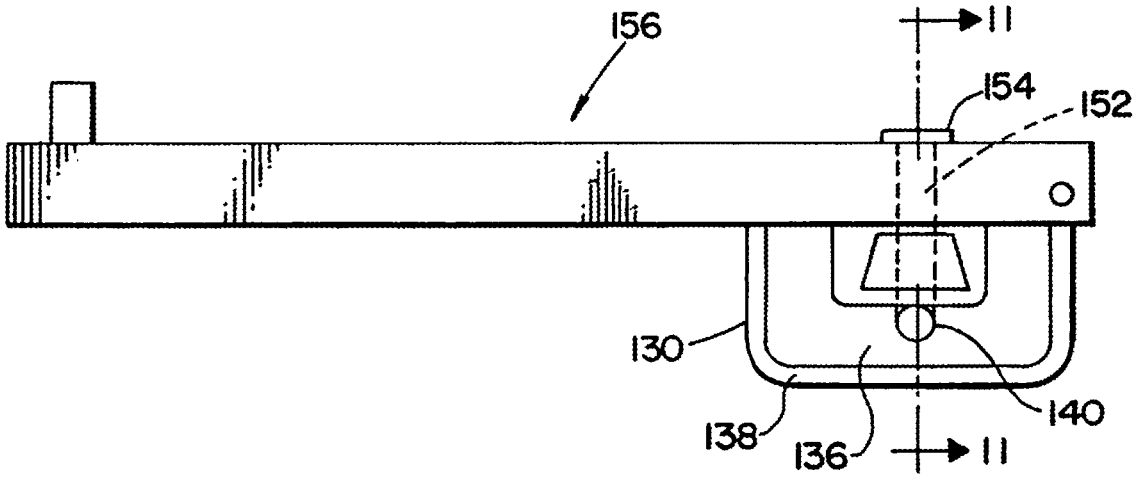
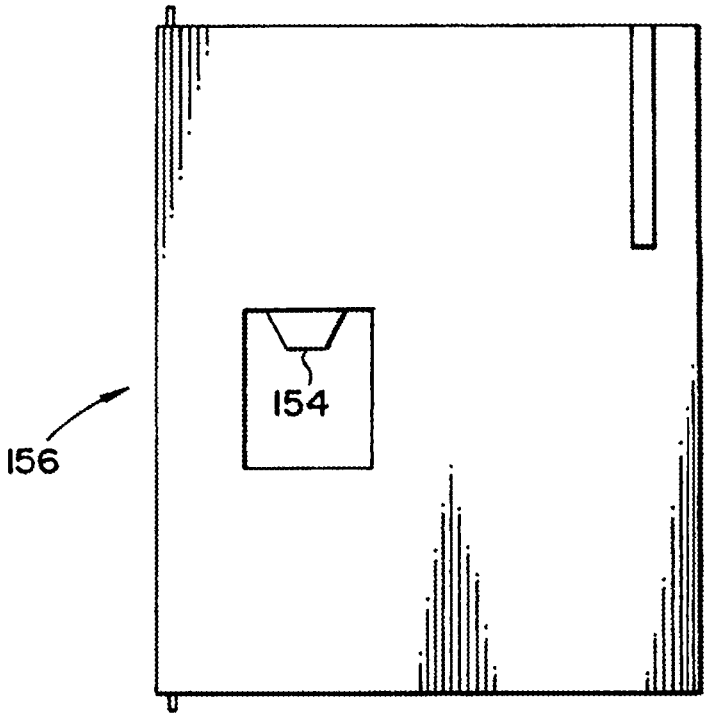
FIG. 10

LIQUID DISPENSER ASSEMBLY FOR USE WITH AN APPLIANCE

RELATED APPLICATIONS

This application is a continuation of U.S. patent application Ser. No. 11/039,363, filed Jan. 20, 2005 now abandoned, which claims the benefit of U.S. Provisional Application No. 60/537,781, filed Jan. 20, 2004, and entitled "Water Filter and Dispenser Assembly," both of which are herein incorporated by reference.

BACKGROUND OF THE DISCLOSURE

Water filtration systems designed for use in the home, such as refrigerator-based systems and under-sink systems, can be used to remove contaminants from water supplies. Due to increasing quality and health concerns with regard to municipal and well-water supplies, the popularity of such filtrations systems has increased markedly in recent years. For example, the inclusion of water filtration systems in refrigerators, once considered a luxury feature, is now included as a standard feature in all but entry level refrigerator designs.

A typical residential water filtration system generally can include a distribution manifold configured to accept a prepackaged cartridge filter. The distribution manifold is typically adapted to connect either directly or indirectly to a residential water supply and to points of use and may even allow for a drain connection. Generally, the prepackaged cartridge filter sealingly engages the distribution manifold such that an inlet flow channel connecting the residential water supply and the cartridge filter is defined, and at least one outlet flow channel connecting the cartridge filter and the points of use and/or the drain is defined.

By associating a liquid distribution assembly with an appliance having cooling capability, a cooled liquid can be supplied to the end user. Cooled liquids can be a desirable feature for a consumer. In general, the liquid distribution assembly may or may not have an associated filtration capability. Suitable appliances can be, for example, a refrigerator with a refrigeration compartment for storage of consumables and a freezer compartment.

SUMMARY OF THE DISCLOSURE

In some presently preferred representative embodiments, the disclosure pertains to a liquid filtering and dispensing system formed as an integral unit or assembly that is configured for placement within an appliance compartment. The system can comprise a manifold with a filter connector with an inflow and outflow for attachment to a filter cartridge, an inlet, at least one outlet forming a liquid dispenser, flow channels fluidly connecting to the inlet and outlet and a valve to control liquid flow through the integral system. The liquid filtering and dispensing system can be formed for easy mounting within the appliance internal compartment, such as, for example, along the top of the refrigerator compartment. The liquid filtering and dispensing system can optionally further comprise a carafe and a carafe mount configured such that the carafe can receive liquid from the dispenser. Also, the system can comprise a storage tank operatively connected to the flow channels.

In some presently preferred representative embodiments, the disclosure pertains to a liquid filtering and dispensing system designed for placement within a refrigeration compartment of an appliance, such as a refrigerator or other appliance for providing chilled liquids. The liquid filtering and dispensing system can comprise a manifold with a filter connector with an inflow and an outflow for attachment to a filter cartridge, a liquid dispenser in fluid communication with the manifold and a carafe mount positioned for facilitating liquid flow from the dispenser into a carafe when the carafe is operatively positioned on the carafe mount. The carafe mount can also be operatively positioned within the refrigerator compartment or within the refrigerator door.

In additional presently preferred representative embodiments, the disclosure pertains to a water distributing system within a refrigeration appliance with one dispenser operatively positioned within a refrigeration compartment. A shelf within the appliance is configured to hold a carafe with a check valve connected to a port. The shelf has a supply port designed to operatively engage the check valve to provide for water flow from the carafe into the supply port. The supply port is connected to a second dispenser. The shelf is positioned such that the carafe operatively positioned on the shelf can receive liquid from the dispenser within the refrigeration compartment.

BRIEF DESCRIPTION OF REPRESENTATIVE EMBODIMENTS

FIG. 9 is a top view of an embodiment of a refrigerator door for use with the refrigerator of FIG. 8.

FIG. 10 is a front view of the refrigerator door of FIG. 9.

DETAILED DESCRIPTION OF REPRESENTATIVE EMBODIMENTS

Figure 1:
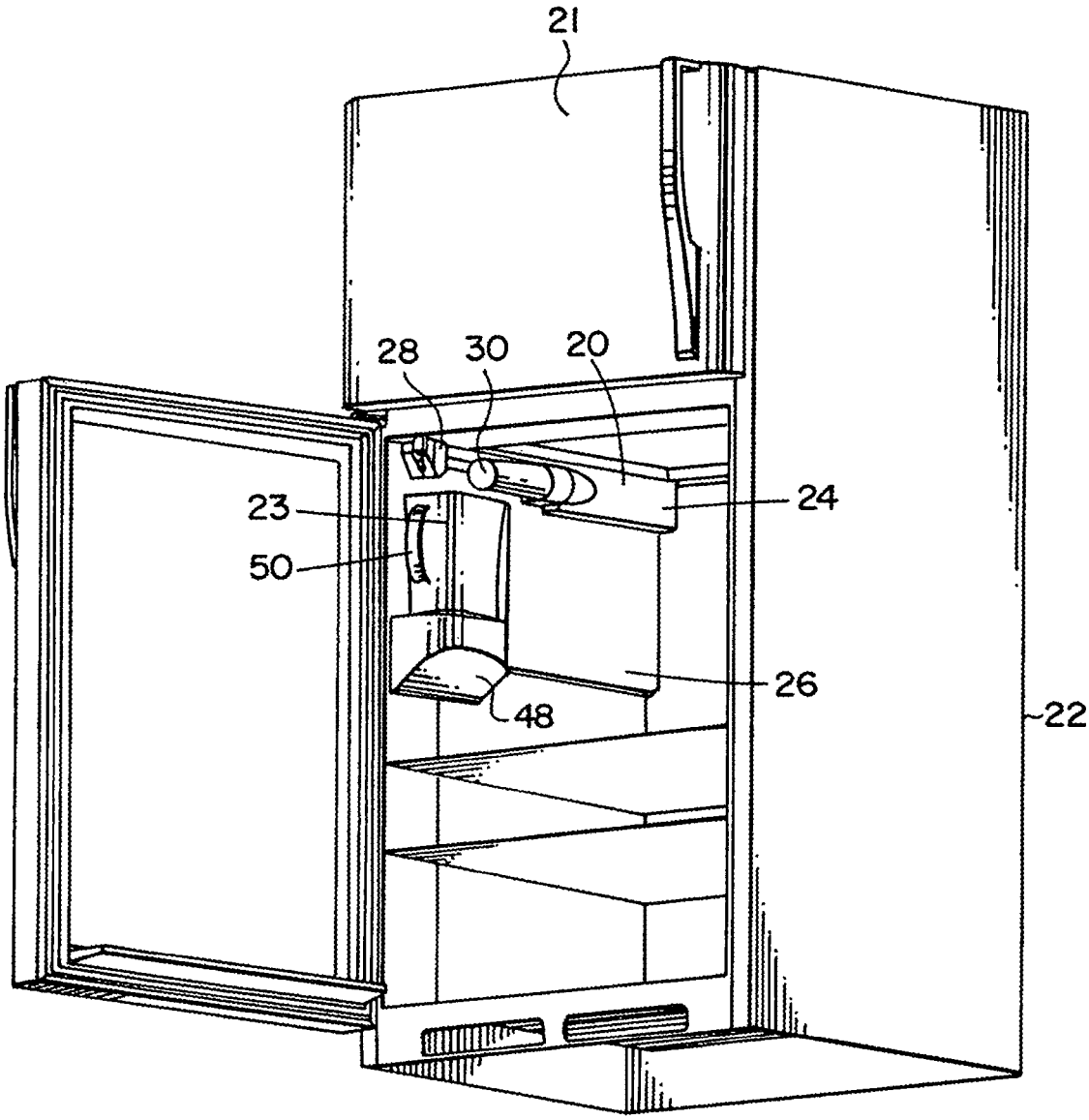
FIG. 1 is a perspective view of a refrigerator illustrating a representative filtration and dispensing unit of the present disclosure in the top left hand corner of the refrigeration compartment and a removable carafe assembly mounted in the refrigeration compartment.

The improved liquid filtration and dispensing system described herein can incorporate one or more of several desirable features. The liquid dispensing system can have a filtration function, such as through the use of a replaceable filter cartridge. In particular, the system can be designed to have the filtration and dispensing functions within an appliance, such as a refrigerator or a dedicated liquid dispensing appliance, in contrast with systems that have a dispenser just within the door of the appliance. In further presently preferred representative embodiments, the system can comprise a carafe and corresponding control system to fill the carafe in a controlled way when appropriate. The carafe can provide a predictable amount of filtered water for delivery to the user. As presently envisioned, the carafe can be filled under either high pressure or low pressure conditions, as would be understood by one skilled in the art.

In some presently preferred representative embodiments, the flow control valve(s) and/or the dispenser assembly are integral with a distribution manifold such that the integral assembly can be installed as a unit within an appliance. Thus, the manifold, filter attachment and output dispenser unit can be mounted into an appliance, such as, for example, a refrigerator, as an integral assembly, thereby reducing the unit installation time. The integral assembly can further comprise one or more flow valves, a storage tank, a controller, a display and/or the like. The integral assembly can be designed for mounting, for example, in an upper corner of an appliance. The filter may or may not be designed and positioned for tilting or any similar design that might be effective to facilitate filter replacement. The dispenser within the appliance generally comprises a switch that can be actuated conveniently by a user to dispense water in a container, such as a glass or pitcher, for example, by pushing the container against the switch.

An integral assembly with all or a significant portion of the components of a liquid dispensing system can provide significant advantages when mounted within the appliance. Specifically, an integral assembly reduces the number of fluid connections required for incorporation into the appliance. For example, in some representative embodiments, only one connection to an inflow line is necessary, while in other representative embodiments, additional connections are required for alternative outflow lines, such as, for example, to an icemaker.

The attachment of the integral assembly can involve attachment of mounting brackets or the like between the appliance and the distribution system or the engagement or other mounting structures to hold the distribution system in place within the appliance compartment. Any mounting structure presently known in the art or developed in the future that is effective to accomplish this function can be used for the attachment. However, it should be noted that the integral nature of the assembly facilitates the attachment.

The integral assembly generally is self-supporting in the sense that the portions of the assembly hold together against the weight of the assembly or any portion thereof if any portion of the assembly is supported. However, the integral assembly or portion thereof may or may not be rigid as long as the assembly is self-supporting. The integral assembly can have, for example, a rigid frame to which the components of the assembly are secured. In alternative or additional representative embodiments, the components of the system can be configured to incorporate portions of different components such that assembly of the components inherently form an integral structure. For example, a rigid molded polymer structure can have components of a manifold, a filter connector, an inlet connection, and a dispenser such that all of these components are self-supporting through the polymer structure after assembly.

The fluid dispensing systems described herein may have one or both of two types of fluid storage structures that provide a ready supply of liquid, presently preferably chilled, such as, for example, water. A first type of water storage structure is a tank that is integral to the flow structure of the dispensing system. Suitable tank structures range from coiled tube tanks, serpentine flow path tanks and open volume tanks. The storage tanks can be incorporated into the integral assembly for mounted within the appliance. Another type of fluid storage structure is a removable carafe or the like.

The carafe can have a structure coordinated with other structural elements of the system. For example, the carafe can have suitable structure for mounting the carafe on the dispenser. Alternatively or additionally, the carafe can rest on a shelf positioned to place the carafe immediately below a dispenser. In some presently preferred representative embodiments, the carafe is operatively positioned within the refrigeration compartment where the carafe can be accessed and removed following the opening of a door to the refrigeration compartment. Alternatively, the carafe can be supported within the door while being operatively positioned to receive liquid from a dispenser within the refrigeration compartment when the door is closed and being removable from the door when the door is open. The carafe can have a valve operatively positioned at or near the bottom of the carafe that interfaces with a flow system when the carafe is operatively positioned in a position such that the fluid in the carafe can feed an alternative distribution channel, such as a dispenser operatively positioned at the exterior of a door to the refrigeration compartment.

Figure 2:
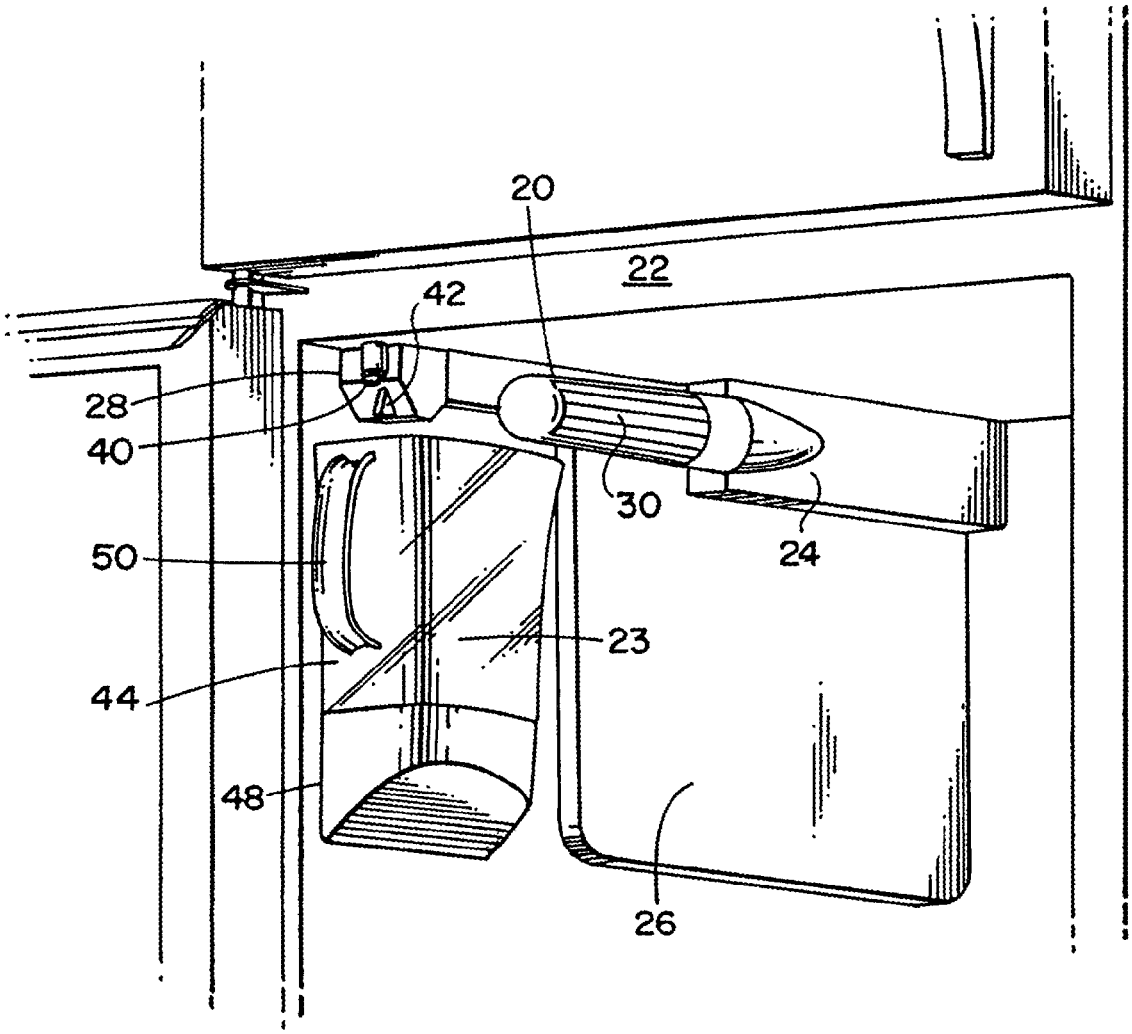
FIG. 2 is a fragmentary perspective view of the refrigerator of FIG. 1.
Figure 3:
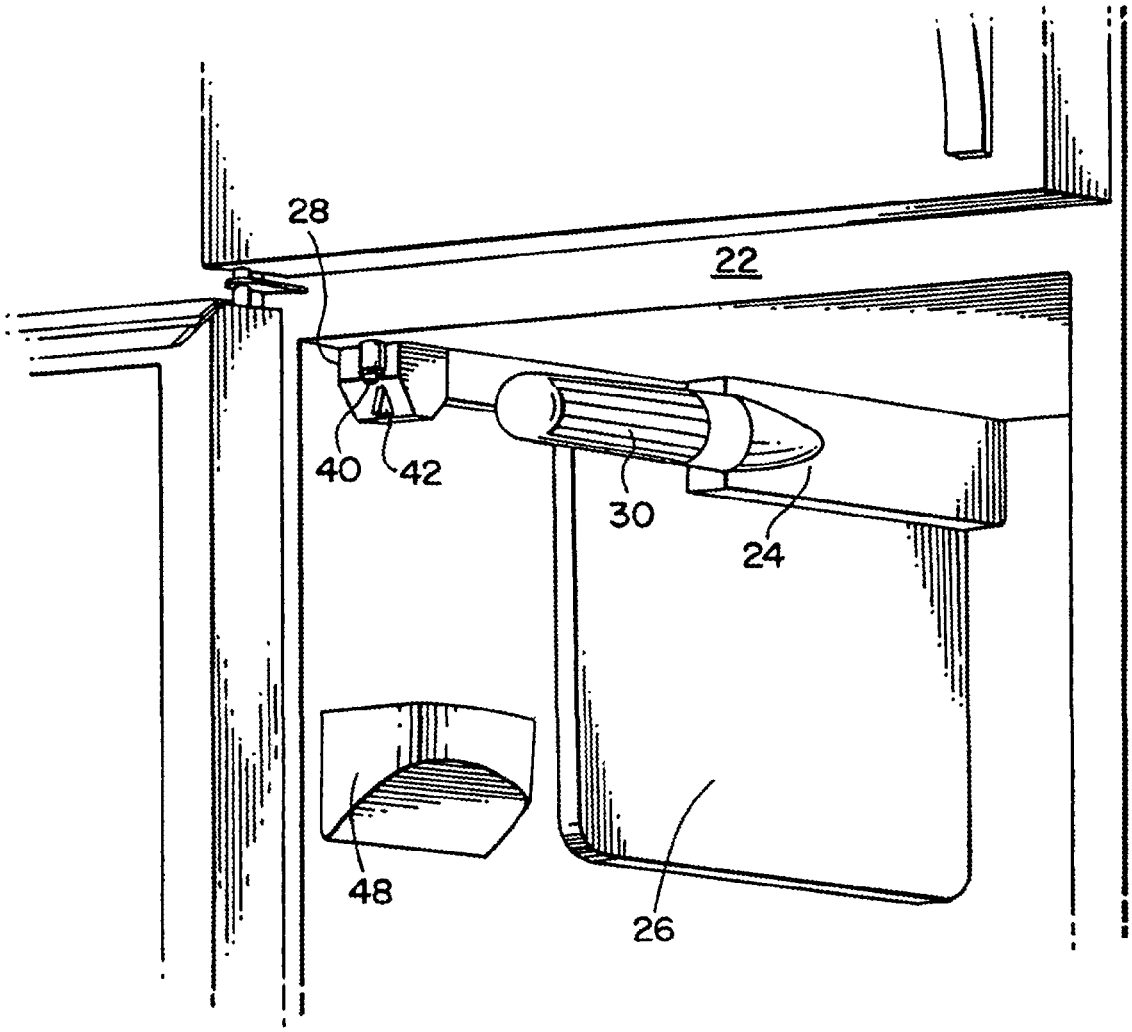
FIG. 3 is a fragmentary perspective view of the refrigerator of FIG. 1 with the carafe removed.
Figure 4:
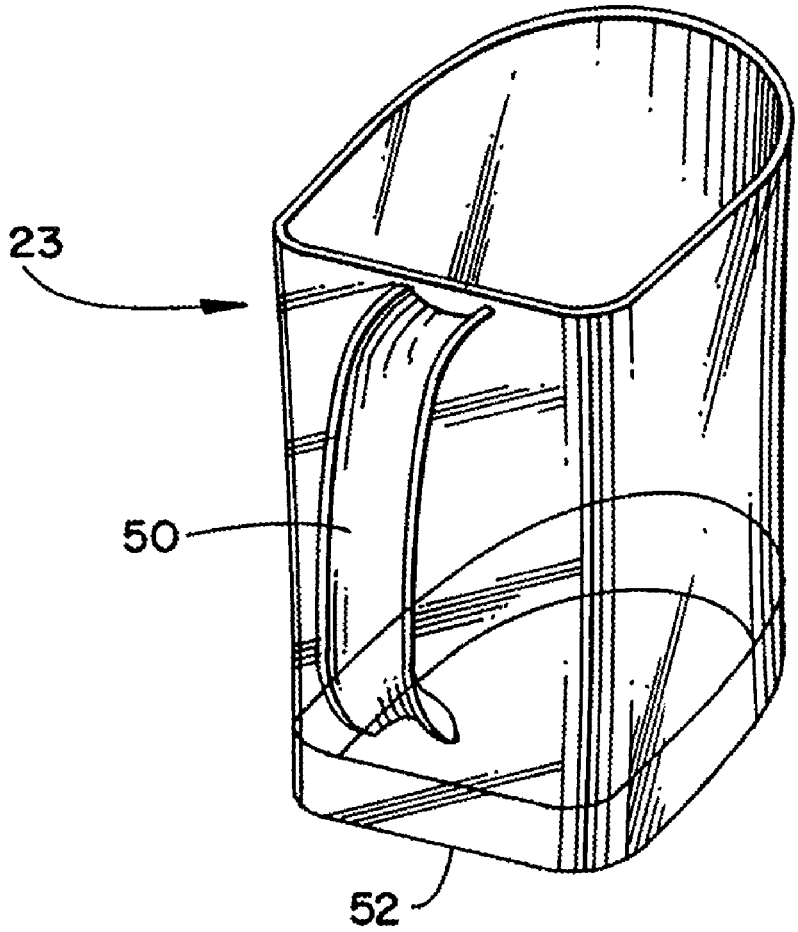
FIG. 4 is a perspective view of the carafe.
Figure 5:
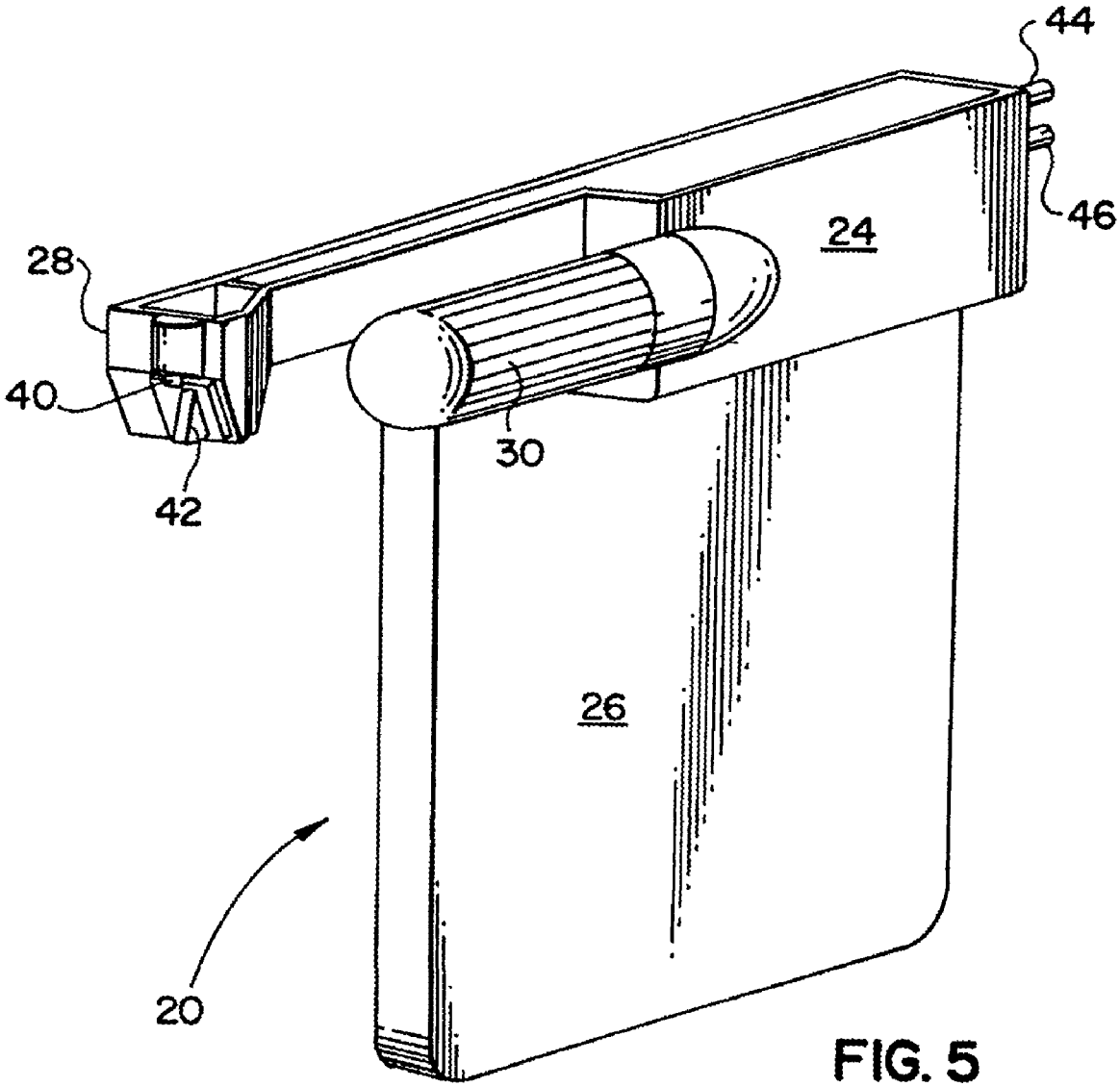
FIG. 5 is a perspective view of the liquid filtration and dispensing system of FIG. 1 separated from the refrigerator with portions cut away to better illustrate certain normally hidden features.
Figure 6:
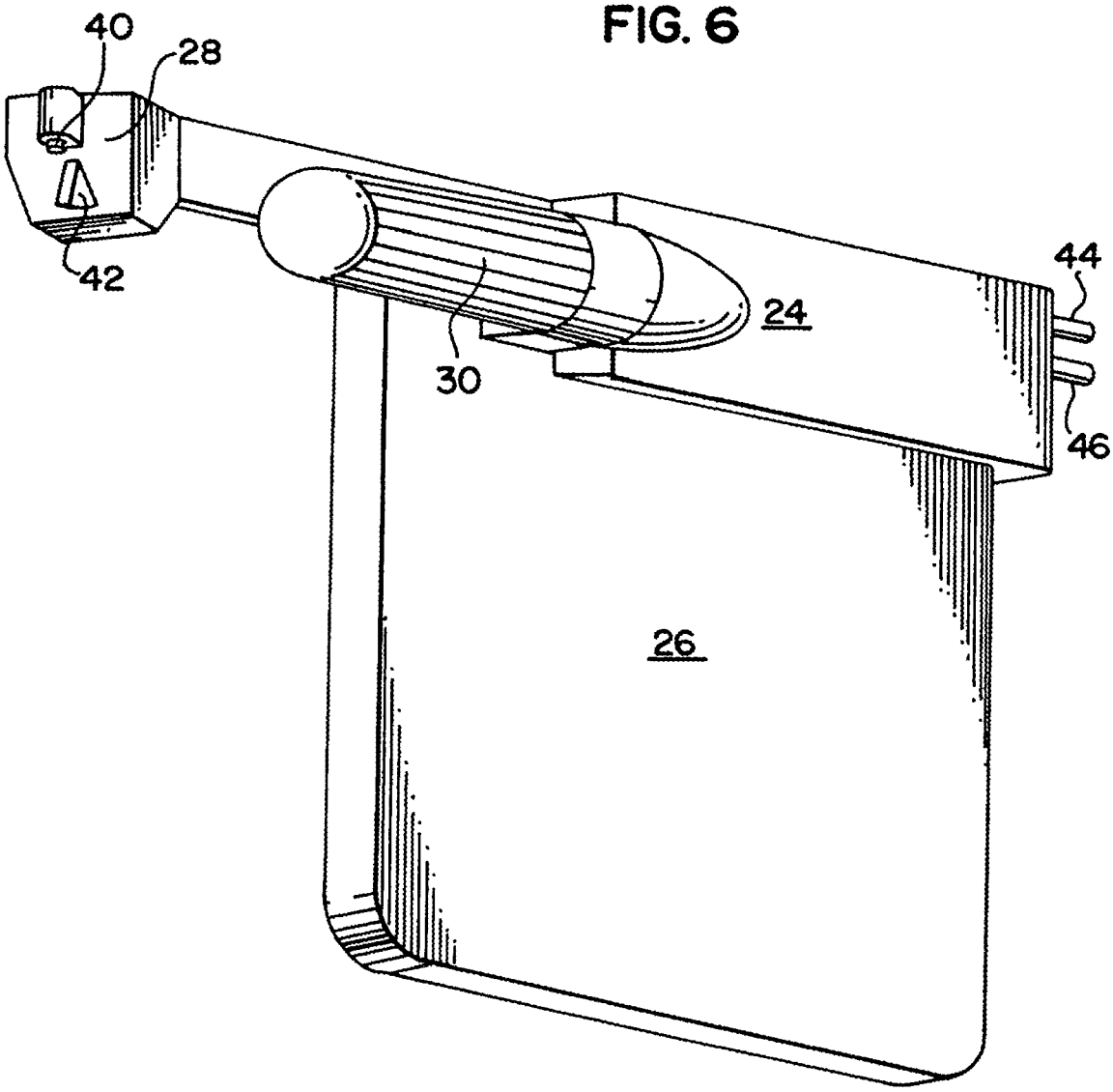
FIG. 6 is a side perspective view of the liquid filtration and dispensing system of FIG. 5.

Referring to FIGS. 1 and 2, one presently preferred representative embodiment of a water filtration and dispensing system 20 is illustrated mounted in the top left hand corner of a refrigerator 22 having a top freezer unit 21. The water filtration and dispensing system can be similarly operatively mounted within the refrigeration compartment of a refrigerator having a variety of alternative configurations, such as, for example, a refrigerator with a lower freezer unit, a side-by-side refrigerator or a refrigerator with no freezer compartment. Also, the system can alternatively be operatively mounted at other locations within the refrigeration compartment. Similarly, the water filtration and dispensing system can be mounted within other appliances such as a dedicated water delivery appliance just for the dispensing of a liquid from a refrigeration compartment with a door in which the appliance lacks additional space for food storage within the refrigeration compartment. FIG. 3 illustrates water filtration and dispensing system 20 with a carafe 23 removed. The removed carafe 23 is illustrated in FIG. 4. Two views of the water filtration and dispensing system separate from the refrigerator are illustrated in FIGS. 5 and 6, respectively.

Referring to FIGS. 1 and 2, water filtration and dispensing system 20 comprises a manifold assembly 24 with a cooling reservoir 26 and a dispenser unit 28. Water filtration and dispensing system 20 is in the form of an integral assembly for mounting within the refrigerator 22. Manifold assembly 24 operatively, fluidly connects with a replaceable filter element 30.

In another presently preferred representative embodiment, replaceable filter element 30 comprises a preassembled, sealed cartridge filter. The cartridge filter can be replaceably, operatively attached to the manifold assembly 24 in conjunction with engagable retaining features present on the replaceable filter element 30 and the manifold assembly 24. Replaceable attachment of the replaceable filter element 30 to the manifold assembly 24 can take many forms, such as, for example, including, but not limited to, assemblies and connections for rotatable attachments as described and disclosed in U.S. Pat. Nos. 6,953,526, 7,147,772, 6,632,355 and U.S. Patent Publ. Nos. 2003/0010698A1 and 2003/0019819A1, while assemblies and connections for slidable engagement are disclosed in including, but not limited to, U.S. Pat. No. 7,067,054, each of the preceding applications being incorporated herein by reference to the extent not inconsistent with the present disclosure.

Manifold assembly 24 can comprise a pivoting mount for operatively attaching the manifold assembly 24 to the refrigerator 22 such that replaceable filter element 30 and manifold assembly attachment structure can be rotatably positioned relative to the refrigerator to facilitate gripping the replaceable filter element 30 during initial attachment of the replaceable filter element 30 and during subsequent replacements. Suitable pivoting manifold mounts are described, for example, in including, but not limited to, U.S. Pat. No. 7,147,772, which is herein incorporated by reference to the extent not inconsistent with the present disclosure.

Replaceable filter element 30 can comprise any suitable water filtration media such as, for example, powdered and granular activated carbon media, ceramic filtration media, powdered polymeric filtration media, manganese greensand, ion exchange media, cross-flow filtration media, polymeric barrier filtration media, mineral-based fibers, granules and powders, or other appropriate filter media as presently known or as may become available in the future. In some presently preferred embodiments, replaceable filter element 30 can comprise a freeze resistant cartridge filter such as, for example, freeze resistant cartridge filters as disclosed and described in including, but not limited to, U.S. Patent Publ. Nos. 2004/0094468A1 and 2005/0161394A1, each of the preceding applications being incorporated herein by reference to the extent not inconsistent with the present disclosure.

Cooling reservoir 26 can be used to provide a supply of cold liquid, generally, water for dispensing. However, if carafe 23 is used, a cooling reservoir may not be desired. In general, the cooling reservoir 26 can be integral to the manifold assembly 24 and can be operatively fluidly located either upstream or downstream from the replaceable filter element 30. Placement of cooling reservoir 26 upstream provides for filtration of the liquid after leaving the cooling reservoir 26. While various cooling reservoir designs are suitable, presently preferred representative embodiments of cooling reservoir 26 can comprise a reduced and/or low profile reservoir design such as, for example, including, but not limited to, a molded serpentine shaped flow channel that provides first in first out flow with little or no low flow or no flow space. In general, these designs can provide efficient heat exchange, ready incorporation into the desired system, reduced or eliminated stale water and decreased risk of microbial contamination. Suitable tank designs are described further in including, but not limited to, copending U.S. Provisional Applications Nos. 60/591,646, 60/604,952 and 60/634,621, each of the preceding applications being incorporated herein by reference to the extent not inconsistent with the present disclosure.

Dispenser 28 generally comprises a dispenser port 40 and an actuation switch 42 that can open an appropriate valve within manifold assembly 24. Actuation switch 42 can comprise any suitable switch known in the art and can be similar to switches used for door mounted water dispensers. Actuation switch 42 can be operatively configured to provide an electrical signal to the valve or alternatively, actuation switch 42 can manually operatively actuate the valve.

As shown in FIGS. 5 and 6, the water filtration and dispensing system 20 can comprise at least one and possibly two or more additional ports. Two additional ports, an input port 44 and a secondary output port 46, are shown in the rear of the system in FIGS. 5 and 6, although other orientations can be used. Output port 46 can be operatively fluidly connected to an automated water consumption assembly such as, for example, including, but not limited to, an automated ice maker.

Carafe 23 can interface with dispenser 28, as illustrated in FIGS. 1 and 2. Carafe 23 can be supported by a carafe support 48. Carafe support 48 can be independently mounted within the refrigerator, or in an alternative configuration, manifold assembly 24 can be operatively fabricated so as to integrally include carafe support 48. As illustrated in FIG. 4, carafe 23 can comprise a handle 50 and a base 52 such that carafe 23 can be easily operatively removed from and positioned with respect to the water filtration and dispensing system 20. Carafe 23 can have any suitable liquid storage volume such as, for example, including, but not limited to, between about 1 liter to about 1 gallon of liquid storage volume. Carafe 23 can be operatively constructed of a material suitable for cleaning and sanitizing within a dishwasher such that carafe 23 can be routinely cleaned and sanitized to prevent contamination of stored liquid.

As noted above, it may be desirable to integrate the water filtration and dispensing system 20 into a single easy to install assembly for placement within refrigerator 22. The integration of the dispensing system into an integral assembly can be performed in a variety of ways, such as including, but not limited to, forming one or more elements as an integral structure that involve components of a plurality of structures within the system or mounting the structures within the system on a common frame that unites the structures as a unitary structure. Water filtration and dispensing system can further be operatively fabricated using including, but not limited to, any suitable fabrication technique for forming an integral assembly presently known in the art or that may be developed in the future. Suitable fabrication techniques can include, for example, including, but not limited to, appropriate molding techniques, adhesive bonding techniques, thermal bonding techniques, utilization of suitable fasteners, welding techniques and other not yet developed techniques that may be developed and found to be desirable in the future.

The system generally has one or more flow control valves, which may or may not be part of the integral assembly. Suitable valves can be solenoid valves, other valves known in the art or other valves subsequently developed. In one embodiment, one output valve is associated with the dispenser. In other embodiments, an inflow valve is used such that the pressure within a filtration system is generally less than line pressure. If a plurality of output lines is used, a diverter valve and/or a plurality of outlet valves can be used. Particular valve placements are described further below with respect to an alternative embodiment. In general, any reasonable valve placement can be used including, but not limited to, those presently known in the art or those that may be developed in the future that sufficiently performs the requisite function.

The integral assembly generally can be operatively mounted within the appliance by any suitable approach presently known in the art or developed in the future that satisfactorily performs the required function. For example, the integral assembly can be bolted to the body of the appliance. In other embodiments, the integral assembly is attached to the appliance with mounting brackets, braces, interconnecting flanges or the like. The various flow ports on the integral assembly such as, for example, input port 44 and secondary output port 46, can comprise ports adapted for sealable interconnection and attachment to supply and distribution tubing. In some presently preferred embodiments, these flow ports can comprise ports adapted for detachable or permanent connection to supply and distribution tubing such as, for example, through the use of threaded, snap-fit, bonded and/or multi-component connectors such as, for example, including, but not limited to, connectors supplied by the JACO Manufacturing Company of Berea, Ohio, or as described in U.S. patent application Ser. No. 10/929,343, or in U.S. Pat. Nos. 6,857,670, 6,843,512 and 7,156,423 and Patent Publ. No.

2004/0021318A1, the preceding patent application, patents, and publication being incorporated herein by reference to the extent not inconsistent with the present disclosure.

Figure 7:
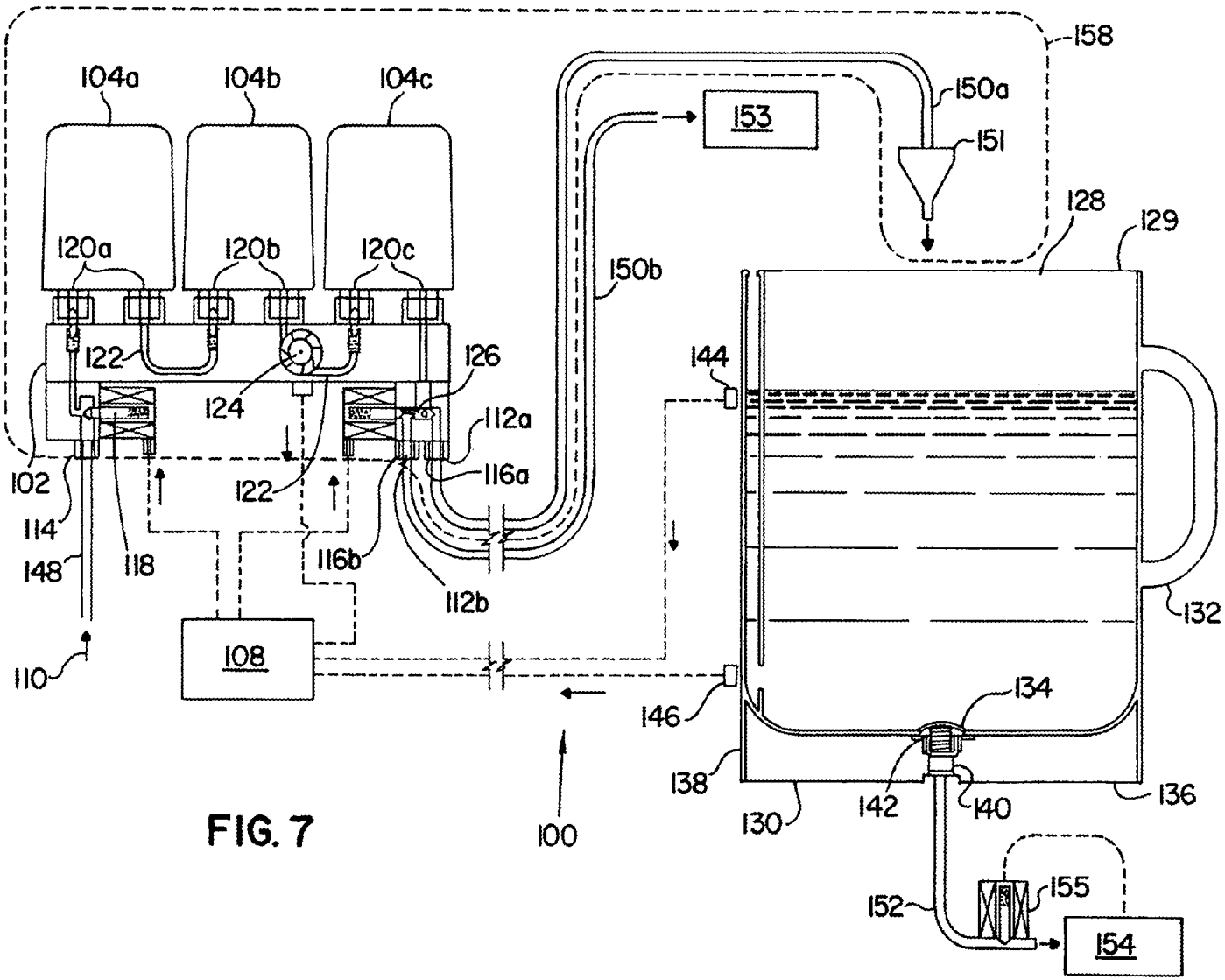
FIG. 7 is a schematic view of a liquid filtration and dispensing system with a carafe to receive flow in a controlled approach.

Another presently preferred representative embodiment of a water filtration system 100 that can be adapted for operative placement within refrigerator 22 with the dispenser also within the refrigerator 22 is illustrated in FIG. 7. Water filtration system 100 can comprise a distribution manifold 102, a plurality of filter elements 104*a*, 104*b*, 104*c*, and a control module 108. As illustrated, water filtration system 100 has an inlet water source 110 and a pair of filtered water outlets 112*a*, 112*b*. In some representative embodiments, distribution manifold 102, filter elements 104*a*, 104*b*, 104*c* and control unit 108 are physically operatively located outside of a refrigerated chamber. While the system is illustrated in FIG. 7 with three filters in series, a different number of filters, such as one, two or four, can similarly be adopted in the water filtration system 100 as an alternative to three.

Distribution manifold 102 can comprise an inlet connection 114 and a pair of outlet connections 116*a*, 116*b*. Located at inlet connection 114 is an inlet valve 118 wired to control module 108. Distribution manifold 102 is further adapted to sealingly engage with filter elements 104*a*, 104*b*, 104*c* at a filter connection 120*a*, 120*b*, 120*c*. Distribution manifold 102 can comprise an internal flow channel 122, which fluidly connects filter connections 120*a*, 120*b*, 120*c* in series. Distribution manifold 102 can further comprise a manifold sensor 124 operatively mounted within the internal flow channel 122 and operatively electrically connected to control unit 108. Manifold sensor 124 can comprise a flow sensor such as, for example, including, but not limited to, an ultrasonic flow sensor, a paddlewheel flow sensor and a turbine flow sensor. Alternatively, manifold sensor 124 can comprise a water quality sensor such as, for example, including, but not limited to, a conductivity or resistivity sensor. Distribution manifold 102 may optionally also comprise a two-position diverter valve 126 just prior to outlet connections 116*a*, 116*b* and electrically operatively connected to control unit 108 to select flow among two or more alternative outlet connections. Filter elements 104*a*, 104*b*, 104*c* comprise pre-assembled filter assemblies and corresponding filter connections for sealing engagement with distribution manifold 102.

As illustrated in FIG. 7, a removable pitcher or carafe 128 can be operatively mounted within a support structure 130. Carafe 128 can have, for example, an open top 129, a handle 132 and a supply port 134, although other operative configurations are presently contemplated. Carafe 128 can be manufactured of a transparent or translucent polymeric material to provide a user with a visible indication of the amount of water present. Carafe 128 can comprise markings for indicating the volume of water present within carafe 128. In some representative embodiments, carafe 128 can have a filtered water capacity of about 0.5 to about 1.0 gallons. Support structure 130 can comprise a floor 136 and a perimeter wall 138. Floor 136 can comprise a distribution port 140 adapted to interface with a check valve 142 integrally mounted within supply port 134. Support structure 130 can further comprise a level sensor 144 and/or a proximity sensor 146, both adapted to interface with the carafe 128 and electrically operatively connected to control unit 108. Level sensor 144 can comprise suitable level sensor designs such as, for example, including, but not limited to, mechanical float sensors, magnetic float sensors, optical sensors, non-contact capacitance sensors, or other suitable level sensors known in the art or other level sensors subsequently developed. Proximity sensor 146 can comprise suitable proximity sensor designs such as, for example, including, but not limited to, electrical switch sensors, micro switch sensors, capacitance sensors, radio frequency identification sensors, and optical sensors including retroreflective, diffused proximity, opposed modes and convergent proximity sensors as well as other suitable proximity sensors known in the art or other proximity sensors subsequently developed.

Control unit 108 may comprise a computer processor, a PLC (Programmable Logic Controller), an electronic logic circuit and/or a plurality of contacts on a terminal strip. Generally, inlet valve 118, flow sensor 124, diverter valve 126, level sensor 144 and proximity sensor 146 are electrically connected to control unit 108, which may be located at one position or at several locations. Based on inputs received from flow sensor 124, level sensor 144, proximity sensor 146 and any other inputs associated with or external to reduced pressure water filtration system 100, control unit 108 controls operation of inlet valve 118. Control unit 108 may be a unique component of the reduced pressure water filtration system 100 or may be an appliance control unit controlling multiple systems.

When fully assembled, a length of inlet tubing 148 can fluidly connect inlet water source 110 with inlet connection 114, a length of outlet tubing 150*a* can fluidly connect filtered water outlet 112*a* to a dispenser 151, a length of outlet tubing 150*b* can fluidly connect filtered water outlet 112*b* to an alternative point of use, for example an automatic ice maker 153, and a length of delivery tubing 152 can fluidly operatively connect distribution port 140 to a door mounted dispenser 154 or other point of use. Door mounted dispenser 154 can comprise a dispenser valve 155 actuatable through interaction with the door mounted dispenser 154. Dispenser 155 can comprise a solenoid valve or other suitable valves known in the art or other valves subsequently developed.

As illustrated in FIG. 7, one presently preferred representative embodiment of water filtration system 100 can comprise a low pressure system in which flow through the filters is generally subject to atmospheric pressure rather than line pressure. Such low pressure configurations and designs are described and disclosed in copending U.S. Provisional Application No. 60/505,152 to Fritze, entitled, "Reduced Pressure Water Filtration," which is herein incorporated herein by reference to the extent not inconsistent with the present disclosure. In another presently preferred embodiment, a water filtration system 100 can be configured to operate at line pressure with a flow control valve placed upstream from filter elements 104*a*, 104*b*, 104*c*. Regardless of the configuration, water filtration system 100 can comprise comparable control elements with respect to the carafe 128.

Figure 8:
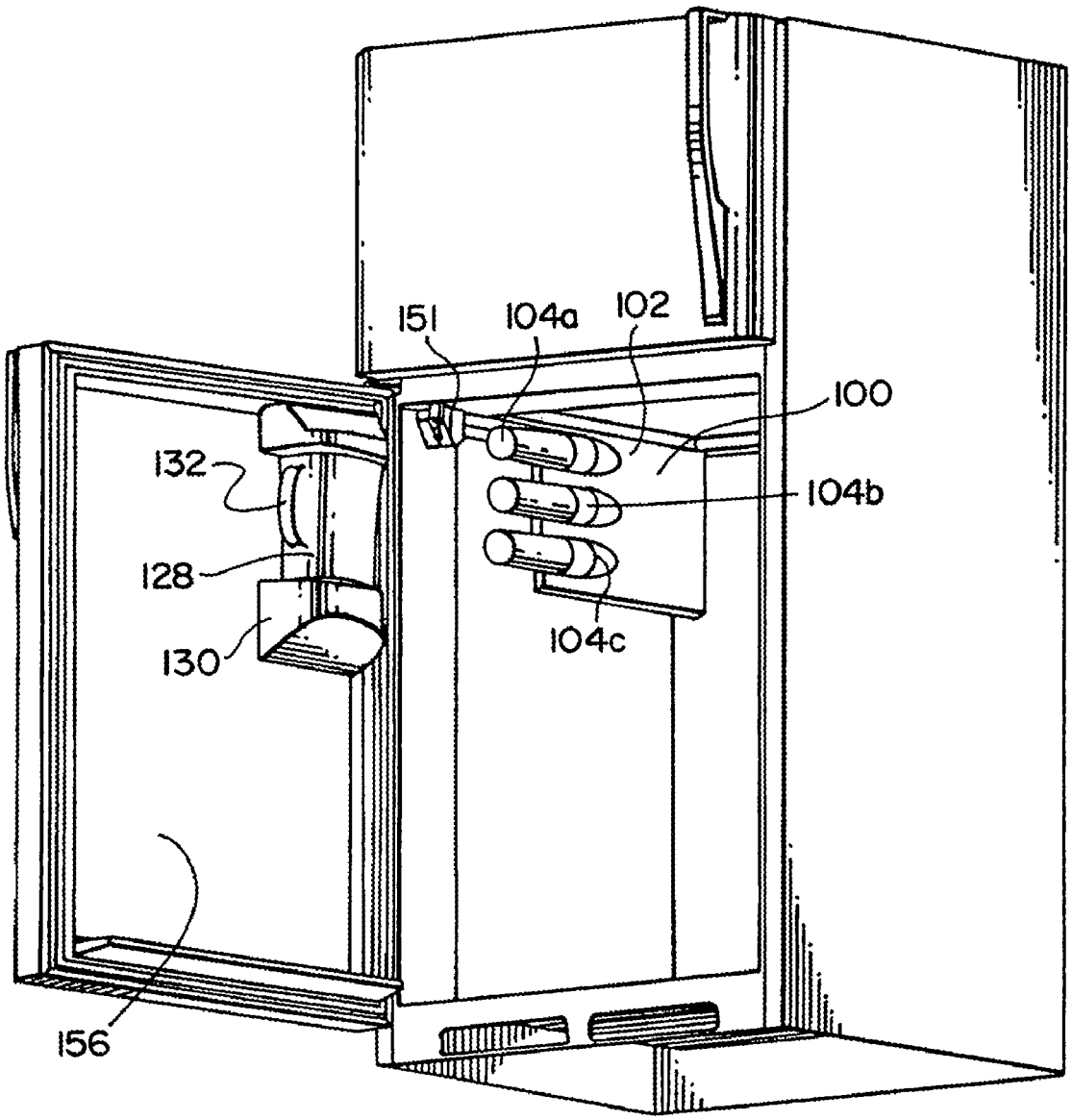
FIG. 8 is a perspective view of a refrigerator with an alternative embodiment of a liquid filtration and dispensing unit mounted in the top left hand corner of the refrigeration compartment and a removable carafe assembly mounted in the door.
Figure 11:
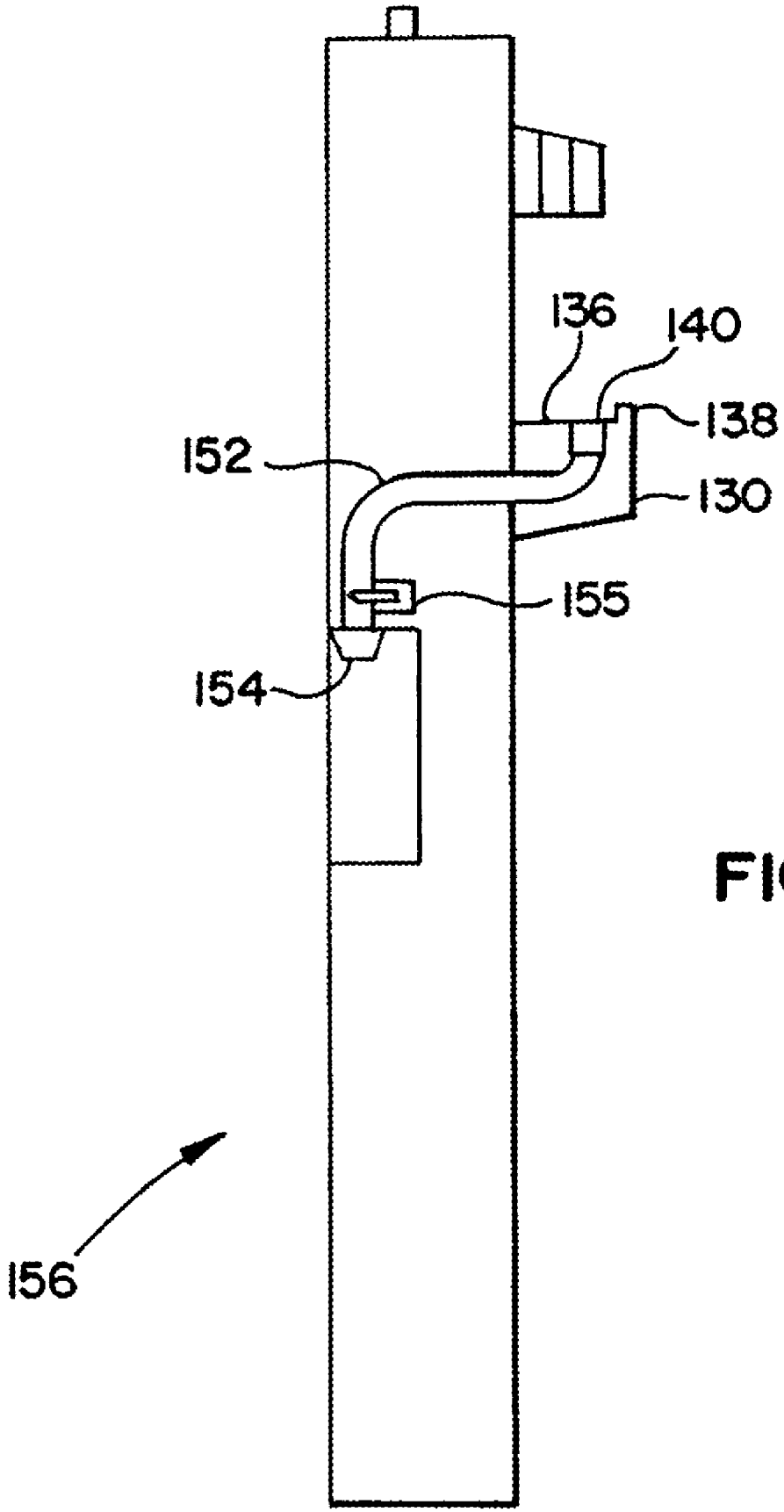
FIG. 11 is a section view of the refrigerator door of FIG. 9 taken at line 11-11 of FIG. 9.

With respect to the automatic control of flow into the carafe, a specific embodiment with this feature is described further below. Suitable operative locations within a refrigeration compartment for a carafe can include, for example, but not limited to, mounted along a refrigerator wall proximate the dispenser, either as part of a manifold assembly or supported on a fixed support as shown in FIG. 1 or on a refrigerator door 156 and projecting into the refrigeration compartment, as shown in FIGS. 8 and 9. With respect to the embodiment depicted in FIGS. 8, 9, 10 and 11, manifold assembly 102, filter elements 104*a*, 104*b*, 104*c* and dispenser 151 can comprise an integral mounting assembly 158, illustrated schematically in FIG. 7, so as to promote placement into and attachment to a water dispensing appliance. Integral mounting assembly 158 can be fabricated using similar fabrication methods as previously described above with respect to water filtration and dispensing system 20.

With respect to the optional carafe 128, support structure 130 can be operatively positioned and operatively attached to the inside of the refrigerator such that when carafe 128 is mounted within support structure 130, open top 129 is positioned below the dispenser 151. The dispenser 151 can thus maintain a desired level of water in the carafe 128 as long as the carafe 128 remains in place. Level sensor 144 and/or proximity sensor 146 can communicate with control unit 108 so as to provide an indication of when the dispenser 151 should dispense water into carafe 128 so as to substantially eliminate the possibility that carafe 128 is overfilled or that carafe 128 is not physically present below the dispenser 151 which can result in water spillage. The carafe 128 can be removed when desired to dispense liquid. In some presently preferred representative embodiments, the support structure 130 can be mounted within a refrigerator door such that carafe 128 is physically located within the refrigerator door and projects into the refrigeration compartment, as illustrated in FIGS. 8 and 9.

In some presently preferred representative embodiments, dispenser 151 can be located on the support structure 130, the distribution manifold 102 or independently on an interior wall of the refrigerator. In some representative embodiments such as, for example, when carafe 128 is located on an interior portion of the refrigerator door as illustrated in FIGS. 8 and 9, the carafe 128 can be in position to receive water from dispenser 151, operatively mounted on the inside of the refrigerator unit, only when the door is closed. When the door is open, the carafe 128 is out of the way of the dispenser 151 such that a user can directly obtain water from the dispenser or from the carafe 128 by removing and pouring the liquid from the carafe. In either configuration, the carafe 128 can be operatively connected to a tube, such as, including, but not limited to, delivery tubing 152 in FIG. 7 that can be used to distribute liquid from the carafe 128 through supply port 134 to door mounted dispenser 154, as illustrated in FIG. 10.

Due to the volume of stored liquid within carafe 128, dispenser 151 can operate at a substantially higher dispensing rate than representative filtration systems in which a dispenser is directly fluidly coupled to the filtration system. As stored liquid within carafe 128 may already have been filtered, there is no pressure drop associated with a filter element between carafe 128 and dispenser 151. At the same time, the storage volume of carafe 128 can provide a usage buffer allowing water filtration system 100 to operate at lower flow than is otherwise practical. The storage volume of carafe 128 provides for system design flexibility in that the filtration rate need not be directly tied to an acceptable dispensing rate. For instance in some representative embodiments, the storage volume of carafe 128 can allow for water filtration system 100 to operate at flow rates such as, for example, between about 0.05 gallons per minute to about 2.0 gallons per minute, between about 0.1 gallons per minute to about 1.0 gallons per minute or between about 0.2 gallons per minute to about 0.75 gallons per minute. As opposed to alternative filtration systems that operate at 0.6 gallons per minute without utilizing a carafe. In this example, even though water filtration system 100 can operate at a reduced flow as compared to the alternative system without a carafe, carafe 128 can provide a higher immediate flow rate of cooled liquid through dispenser 151. For example, dispenser 151 can dispense cooled liquid at rates such as, for example, between 0 to about 4.0 gallons per minute, 0 to about 2.0 gallons per minute or between about 0 to 1.0 gallons per minute. Carafe 128 can then be filled over time with the reduced flow rate of water filtration system 100 while achieving acceptable performance for a user. Operating a filtration system at reduced flow rates can have operating efficiencies and advantages such as, for example, increased contact time between the liquid and filtering media, filtration at low pressure which can lead to less costly components, and the use of high-pressure drop filtration media such as, for example, including but not limited to, cross-flow filtration membranes that produce reduced filtered water flow rates when operated under generally available residential line pressure conditions.

Although various representative embodiments of the present claimed invention have been disclosed here for purposes of illustration, it should be understood that a variety of changes, modifications and substitutions may be incorporated without departing from either the spirit or scope of the present claimed invention.

What is claimed is:

1. An appliance comprising:

a refrigeration compartment having a refrigerator door moveable from a closed position to an open position, the refrigerator door comprising a first side and a second side, wherein, when the refrigerator door is in the closed position, at least a portion of the first side is exposed to the refrigeration compartment and the second side forms an outside surface of the appliance;

a dispensing system positioned inside the refrigeration compartment;

an inlet water source in fluid communication with the dispensing system;

a water filtration system positioned in the inlet water source upstream of the dispensing system;

a carafe support positioned on the first side of the refrigerator door inside the refrigeration compartment and configured to support a carafe in fluid communication with the dispensing system;

a carafe removably positioned in the carafe support; and a door mounted dispenser positioned on the second side of the refrigerator door and configured to dispense fluid outside of the appliance, wherein the door mounted dispenser is in fluid communication with the carafe through a distribution port connected to the carafe support;

wherein, when the refrigerator door is in the closed position, the carafe is in fluid communication with the dispensing system, and when the refrigerator door is in the open position, the carafe is not in fluid communication with the dispensing system.

2. The appliance of claim 1 wherein, when the carafe is positioned in the carafe support, the distribution port opens a check valve connected to a supply port on the carafe.

3. The appliance of claim 1 further comprising a level sensor positioned to sense a fluid level in the carafe, wherein the level sensor is electrically connected to a control unit to provide an indication of overfilling of the carafe.

4. The appliance of claim 3 wherein the level sensor is positioned on the carafe support.

5. The appliance of claim 1 further comprising a proximity sensor positioned to sense the presence of the carafe in the carafe support, wherein the proximity sensor is electrically connected to a control unit to disable the dispensing system when the carafe is removed.

6. The appliance of claim 5 wherein the proximity sensor is positioned on the carafe support.

7. The appliance of claim 1 further comprising a cooling reservoir positioned inside the refrigeration compartment upstream of the dispensing system.

8. The appliance of claim 1 wherein the dispensing system comprises an actuation switch engageable by one of the carafe or the carafe support, wherein the actuation switch opens a dispenser valve fluidly connected to the dispensing system.

* * * * *